US005949011A

United States Patent [19]

Ichiki

[11] Patent Number: 5,949,011

[45] Date of Patent: Sep. 7, 1999

[54] CONFIGURABLE TONE GENERATOR CHIP WITH SELECTABLE MEMORY CHIPS

[75] Inventor: Tetsuji Ichiki, Hamamatsu, Japan

[73] Assignee: Yamaha Corporation, Hamamatsu, Japan

[21] Appl. No.: 09/222,394

[22] Filed: Dec. 29, 1998

[30] Foreign Application Priority Data

Jan. 7, 1998 [JP] Japan ..... 10-011953

[51] Int. Cl.[6] ..... G10H 7/00

[52] U.S. Cl. ..... 84/602; 84/627

[58] Field of Search ..... 84/600–604, 627; 709/400; 712/34; 364/132–134

[56] References Cited

U.S. PATENT DOCUMENTS

| | | | |
|---|---|---|---|
| 5,200,564 | 4/1993 | Usami et al. | 84/602 |
| 5,376,750 | 12/1994 | Takeda et al. | 84/602 |
| 5,541,360 | 7/1996 | Kaneko | 84/660 |
| 5,625,158 | 4/1997 | Ichiki | 84/603 |
| 5,710,386 | 1/1998 | Abe . | |
| 5,804,749 | 9/1998 | Shirakawa . | |

*Primary Examiner*—Jeffrey W. Donels
*Attorney, Agent, or Firm*—Graham & James LLP

[57] ABSTRACT

A tone generator chip is formed of a semiconductor substrate and is configurable under different operation modes in combination with memories accessible via external buses for generating a tone by using the memories. In the tone generator chip, a sound source block is controllable for generating a tone and includes a reading circuit for reading waveform data to generate the tone and a digital signal processing circuit for processing the waveform data to impart an effect to the tone. A central processing unit is integrated in the semiconductor substrate together with the sound source block for controlling the sound source block. A first access manager manages an access status from each of the reading circuit, the digital signal processing circuit and the central processing unit to a first external bus for access to a memory. A second access manager manages an access status from each of the reading circuit, the digital signal processing circuit and the central processing unit to a second external bus provided separately from the first external bus for access to another memory. A mode control designates a specific one of the different operation modes to enable the first access manager and the second access manager to set the respective access statuses, thereby configuring the reading circuit, the digital signal processing circuit and the central processing unit according to the specific operation mode in combination with the memories configured corresponding to the specific operation mode.

14 Claims, 6 Drawing Sheets

TONE GENERATOR LSI
1
MEMORY A
28
A BUS
18
MEMORY B
29
B BUS
19
ACCESS MANAGER A
14
ACCESS MANAGER B
15
READING CIRCUIT
8
EG
9
DSP WITH MIXER
10
SOUND SOURCE REGISTER
7
MODE REGISTER
16
CONTROL SIGNAL A
CONTROL SIGNAL B
BUS LINE
17
11
12
13
ANALOG WAVEFORM INPUT
23
ADC
24
ANOTHER LSI
25
DAC
26
SOUND SYSTEM
27
TIMER
3
CPU
2
PARALLEL I/O
6
SERIAL I/O
5
MIDI INTERFACE
4
PANEL/EXTERNAL CPU
22
KEY BOARD
21
MIDI DEVICE
20

CONFIGURABLE TONE GENERATOR CHIP WITH SELECTABLE MEMORY CHIPS

BACKGROUND OF THE INVENTION

1. Field of the Invention

The present invention generally relates to a tone generator and, more particularly, to a large scale integration chip of the tone generator circuit composed of a sound source block containing a digital signal processor (DSP), and a central processing unit (CPU) mounted on a single semiconductor substrate together with the sound source block.

2. Description of Related Art

Generally, the tone generator is composed of a MIDI (Musical Instrument Digital Interface), a performance input block in which performance information is inputted from a keyboard or a sequencer, a sound source block for generating waveforms of tones, and a CPU for controlling the sound source block according the inputted performance information. The CPU executes driver processing of the sound source block such as channel assignment and parameter conversion according to the inputted performance information, and supplies the converted parameters and note events to assigned channels of the sound source block. The sound source block generates tone data based on the parameters stored in a sound source register. In the case of a wave table method, waveform data is read out from a waveform memory, an envelope is applied to the waveform data, and an effect is imparted to the envelope-applied waveform data by use of a DSP to provide tones.

The CPU is connected to a ROM (Read Only Memory) in which a control program is stored and is connected to a RAM (Random Access Memory) for use as a work area of the CPU. The sound source block is connected to the waveform memory (ROM or RAM) for storing waveform data and a delay memory (RAM) for use by the DSP to impart an effect such as delay. Consequently, four separate memory devices must be arranged if they are provided in the form of discrete components. With recent advancements in semiconductor fabrication technology, it has become possible to use a tone generator chip having the CPU and the sound source block, both of which are mounted on and integrated in a common semiconductor substrate.

However, the above-mentioned tone generator chip with the CPU and the sound source block mounted on the single semiconductor substrate has only one external bus for access to a memory device. Therefore, the configuration of using the external bus by the CPU and the sound source block is uniquely determined. This prevents the tone generator chip from being used flexibly in matching with grades of electronic musical instruments containing the tone generator chip. The sole data bus of the tone generator chip is connected to a memory which stores a program for use by the CPU and waveform data for use by the sound source block. The sharing of the data bus between the CPU and the sound source block restricts the operation of the CPU, thereby limiting the application of the tone generator chip to those electronic musical instruments of comparatively low grades.

SUMMARY OF THE INVENTION

It is therefore an object of the present invention to provide a tone generator chip with the CPU and the sound source block mounted on a single LSI (Large Scale Integration) circuit capable of configuring usage of data buses according to applications or purposes of the chip. It is another object of the present invention to provide a tone generator chip capable of efficiently accessing peripheral memories through data buses.

The inventive tone generator circuit is integrated in a semiconductor substrate and being alterable under different operation modes for generating a tone by accessing external buses. In the inventive circuit, a sound source block is controllable for generating a tone and includes a reading circuit for reading waveform data to generate the tone, an envelope circuit for forming an envelope of the waveform data to regulate an amplitude of the tone, and a digital signal processing circuit for processing the waveform data to impart an effect to the tone. A central processing unit is integrated in the semiconductor substrate together with the sound source block for controlling the sound source block. A first terminal is provided on the semiconductor substrate for connection with a first external bus. A second terminal is provided separately from the first terminal on the same semiconductor substrate for connection with a second external bus. A first access manager manages an access status from each of the reading circuit, the digital signal processing circuit and the central processing unit to the first external bus via the first terminal. A second access manager manages an access status from each of the reading circuit, the digital signal processing circuit and the central processing unit to the second external bus via the second terminal. A mode control designates one of the different operation modes so that the first access manager and the second access manager alter the respective access statuses from each of the reading circuit, the digital signal processing circuit and the central processing unit to each of the first external bus and the second external bus according to the designated operation mode.

Specifically, the mode control designates one of the different operation modes including a single mode, a dual mode and a separate mode. In the single mode, the access status of the reading circuit to the first external bus is on, the access status of the digital signal processing circuit to the second external bus is on, and the access statuses of the central processing unit to the first external bus and to the second external bus are respectively off. In the dual mode, the access status of the reading circuit to the first external bus is on, the access status of the digital signal processing circuit to the second external bus is on, and the access statuses of the central processing unit to the first external bus and to the second external bus are respectively on. In the separate mode, the access status of the reading circuit to the first external bus is on, the access status of the digital signal processing circuit to the first external bus is on, and the access status of the central processing unit to the second external bus is on.

Expediently, the inventive tone generator circuit further comprises additional terminals provided on the semiconductor substrate for connection with another tone generator circuit so that a pair of the tone generator circuits cooperate with each other as a master circuit and a slave circuit.

In another view, the inventive tone generator circuit is integrated in a semiconductor substrate and being alterable under different operation modes for generating a tone by accessing external buses. In the inventive circuit, a sound source block is controllable for generating a tone and includes a reading circuit for reading waveform data to generate the tone, an envelope circuit for forming an envelope of the waveform data to regulate an amplitude of the tone, and a digital signal processing circuit for processing the waveform data to impart an effect to the tone. A central processing unit is integrated in the semiconductor substrate together with the sound source block for controlling the sound source block. A first terminal is provided on the semiconductor substrate for connection with a first external bus. A second terminal is provided separately from the first terminal on the same semiconductor substrate for connection with a second external bus. A first access manager manages an access status from each of the reading circuit, the digital signal processing circuit and the central processing unit to the first external bus via the first terminal. A second access manager manages an access status from each of the reading circuit, the digital signal processing circuit and the central processing unit to the second external bus via the second terminal. A mode control designates either of one operation mode where the access status of the reading circuit to the first external bus is on, the access status of the digital signal processing circuit to the first external bus is on, and the access status of the central processing unit to the second external bus is on, or designates another operation mode where the access status of the reading circuit to the first external bus is on, the access status of the digital signal processing circuit to the second external bus is on, and the access statuses of the central processing unit to the first external bus and to the second external bus are respectively on. Under the one operation mode, the first access manager enables the reading circuit and the digital signal processing circuit to share the first external bus by time-divisional access. Under the other operation mode, the first access manager enables the reading circuit and the central processing unit to share the first external bus by time-divisional access, and the second access manager enables the digital signal processing circuit and the central processing unit to share the second external bus by time-divisional access.

According to the tone generator circuit associated with the present invention, the CPU, the reading circuit and the digital signal processing circuit (DSP) can be selectively connected to the first and second external buses via the first and second terminals according to the designated operation mode. This flexible configuration allows peripheral memory devices such as a waveform memory, a program memory, a work memory, and a delay memory to be selectively accessible through the first and second external buses, thereby making the tone generator chip available for use in various applications.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings. Now, referring to FIG. 1, there is shown an internal constitution of a tone generator chip practiced as one preferred embodiment of the invention. It should be noted that the tone generator chip according to the invention could have any number of tone generation channels or sound channels. The following description will be made using, by way of example, a tone generator chip of the wave table type in which 32 channels of tones can be simultaneously generated at most by time-divisional channel operation.

Figure 1:
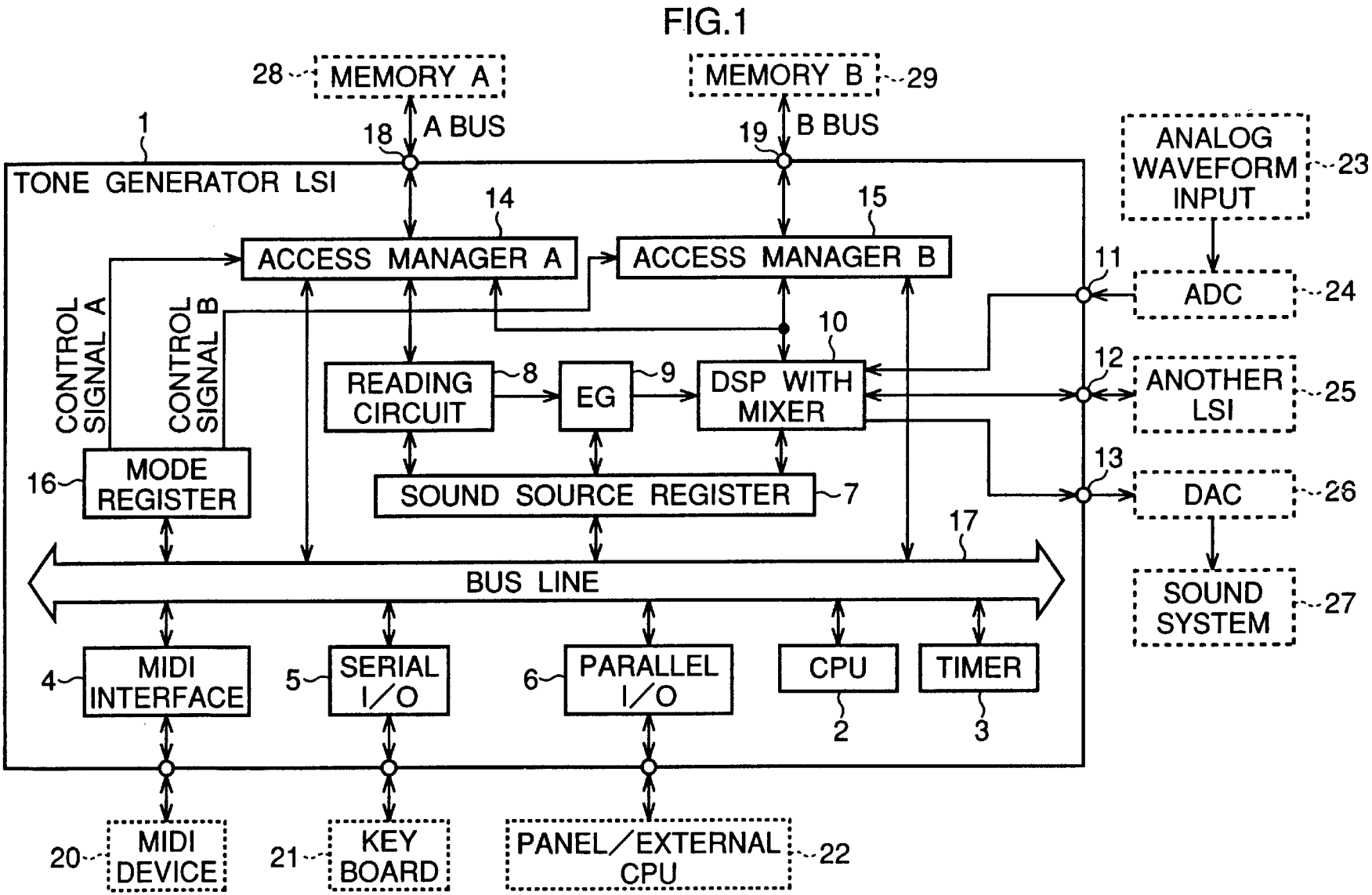
FIG. 1 is a block diagram illustrating a tone generator chip practiced as one preferred embodiment of the invention.

In FIG. 1, reference numeral 1 denotes a tone generator chip (also referred to as a tone generator LSI). The tone generator chip 1 has a CPU 2, a timer 3, a MIDI interface 4, a serial input/output circuit 5, a parallel input/output circuit 6, a sound source register 7, a reading circuit 8, an envelope circuit or envelope generator (EG) 9, a digital signal processing circuit or DSP 10, an access manager A block 14, an access manager B block 15, and a mode register 16. Reference numeral 11 denotes a serial input terminal, reference numeral 12 denotes a serial input/output terminal, reference numeral 13 denotes a serial output terminal, reference numeral 17 denotes an internal bus, reference numeral 18 denotes a first terminal or external bus connector connected to the access manager A block 14, and reference numeral 19 denotes a second terminal or external bus connector connected to the access manager B block 15. The first terminal 18 is connected to a first external bus (A bus). The second terminal 19 is connected to a second external bus (B bus). The buses A and B are connected to a memory A and a memory B, respectively.

The CPU 2 is equivalent to a CPU used in a general-purpose single-chip microcomputer. The CPU 2 has a standby mode in which the CPU 2 stops its operation for power saving. The CPU 2 divides an entire address space into plural areas, and selects a data bus width and an access status for each of the divided areas. The thus configured CPU 2 controls an electronic musical instrument incorporating this tone generator LSI according to a control program stored in a program memory.

The timer 3 performs a clock operation and issues a timer interrupt. The timer 3 is used for the time control, envelope control, and effect control in automatic performance or automatic accompaniment executed by the CPU 2. The MIDI interface circuit 4 executes an input/output operation of MIDI messages. Through the MIDI interface circuit 4, the CPU 2 outputs MIDI data supplied from a music keyboard or other external MIDI data input device to an externally attached MIDI device, and controls the sound source block based on MIDI data supplied from the external MIDI device 20.

The serial input/output circuit (or serial input/output port) 5 executes an input/output operation of a command signal supplied from the keyboard 21 for example. The CPU 2 receives performance information in the form of the MIDI data supplied from the MIDI interface circuit 4 and operation information in the form of the command signal supplied from the keyboard 21 through the serial input/output port 5, thereby executing driver processing of the sound source block. The parallel input/output circuit (or parallel input/ output port) 6 executes an input/output operation of data with an operator panel of the electronic musical instrument for example and another CPU 22 arranged independently of this tone generator LSI. Namely, through the parallel input/output circuit 6, the CPU 2 scans switches of the operator panel and controls a panel indicator. When the CPU 2 is in the standby mode, the external CPU 22 is connected to the sound source register 7 in the tone generator LSI 1 through the parallel input/output circuit 6.

The sound source register 7, the reading circuit 8, the EG 9, and the DSP 10 form the sound source block. The sound source register 7 holds control information. The sound source register 7 has a first area for holding tone control data for controlling 32 channels of tones to be generated by the tone generator LSI 1, a second area for holding mixer control data for controlling a mixer, and a third area for holding DSP control data. To be more specific, the first area stores the tone control data in the form of a note on/off event, a note number, a waveform address, an envelope parameter, and a modulation parameter for controlling the tone generated in each sound channel. The second area stores the mixer control data such as various volume data for volume-controlling and mixing the waveform data outputted from the each sound via EG 9, the waveform data supplied from another LSI 25 and an ADC (Analog-to-Digital Converter) 24, and the waveform data being processed in the DSP 10. The third area stores the DSP control data such as a microprogram for controlling process of a digital signal or waveform data in the DSP 10, coefficient data for use in the digital signal processing and address data for controlling a delay memory associated to the DSP.

The reading circuit 8 starts a waveform read operation for reading the waveform data at the number of sample points necessary for interpolation processing by means of read address incrementing at a rate according to the note number. The waveform data is stored at locations indicated by the above-mentioned waveform address in the waveform memory. As described above, the present embodiment simultaneously generates 32 channels of tones by the time-divisional channel operation. The 32 channels of the read waveform data are outputted in a time-division manner. The reading circuit 8 also interpolates the read waveform data of each sounding channel. The EG 9 forms a volume envelope of the waveform data of each sounding channel outputted from the reading circuit 8. For each sounding channel, according to the input of note-on event, the EG 9 generates an envelope waveform indicative of time variation in the amplitude of the waveform data based on the above-mentioned envelope parameter, thereby executing volume control on 32 channels of time-divided waveform data outputted from the reading circuit 8 according to the envelope waveform.

The DSP 10 with the mixer mixes the waveform data of the sounding channels to generate tone waveform data for each sampling period and, at the same time, imparts an effect such as chorus, reverberation and variation to the generated waveform data. Based on the above-mentioned mixer control data, the mixer in the DSP 10 mixes the tone data from the sounding channels with the tone data supplied from the external tone generator LSI 25 and the ADC 24, or with the tone data being processed in the DSP 10 in two or more ways. Using a part of the mixed results, the DSP 10 executes digital signal processing based on the above-mentioned microprogram and supplies the other part of the mixing results to the external tone generator LSI 25 and the DAC (Digital to Analog Converter) 26.

The access manager A block 14 executes access control on the data accesses by those of the CPU 2, the reading circuit 8, and the DSP 10 to the peripheral A memory 28 connected to the external memory bus (A bus) via the first terminal 18. The access manager B block 15 executes access control on the data accesses by those of the CPU 2, the reading circuit 8, and the DSP 10 to the B memory 29 connected to the second external memory bus (B bus) via the second terminal 19. The mode register 16 sets the operation mode of the tone generator LSI 1. The data held in the mode register 16 determines the state of access control by the access manager A block 14 and the access manager B block 15. It should be noted that the data held in the mode register 16 is set by the state of logical levels of plural mode terminals Vcc relative to a ground level E. the mode register 16 and the mode terminals constitute a mode control for enabling the address manager blocks to manage the respective access status of the reading circuit, the DSP and the CPU.

As described before, the tone generator LSI 1 can be connected to various memory devices having different operation speeds and data widths. According to the operation mode set by the mode register 16, the waveform memory, the program memory, the work memory and the delay memory may be connected to the A bus or the B bus to have the tone generator LSI 1 operate at various grades in an electronic musical instrument. Namely, the inventive tone generator chip 1 is formed of a semiconductor substrate and being configurable under different operation modes in combination with memories accessible via external buses for generating a tone by using the memories. In the inventive tone generator chip 1, the sound source block is controllable for generating a tone and includes at least the reading circuit 8 for reading waveform data to generate the tone and the digital signal processing circuit or DSP 10 for processing the waveform data to impart an effect to the tone. The central processing unit 2 is integrated in the semiconductor substrate together with the sound source block for controlling the sound source block. The A block 14 of the first access manager manages an access status from each of the reading circuit 8, the digital signal processing circuit 10 and the central processing unit 2 to the first external bus (A bus) for access to the Peripheral A memory 28. The B block 29 of the second access manager manages an access status from each of the reading circuit 8, the digital signal processing circuit 10 and the central processing unit 2 to the second external bus (B bus) provided separately from the first external bus (A bus) for access to the other peripheral B memory 29. The mode control including the mode register 16 designates a specific one of the different operation modes to enable the first access manager 14 and the second access manager 15 to set the respective access statuses from each of the reading circuit 8, the digital signal processing circuit 10 and the central processing unit 2 to each of the first external bus (A bus) and the second external bus (B bus), thereby configuring the reading circuit 8, the digital signal processing circuit 10 and the central processing unit 2 according to the specific operation mode in combination with the A memory 28 and the B memory 29 configured corresponding to the specific operation mode.

The following describes the operation modes of the tone generator LSI 1. In the first operation mode (or the single mode), the CPU 2 is put in the standby mode, and therefore the sound source block alone operates. The access manager A block 14 connects the reading circuit 8 to the external bus terminal 18 (A bus). The access manager B block 15 connects the DSP 10 to the external bus terminal 19 (B bus). The A bus is connected to the peripheral A memory in the form of an external waveform memory, and the B bus is connected to the peripheral B memory in the form of an external delay memory. In the single mode, the tone generator LSI 1 in its entirety operates as a 32-channel tone generator chip, allowing the external CPU 22 to directly access the sound source register 7 through the parallel input/output circuit 6. In this case, no conflict occurs between the data accesses to the waveform memory and the delay memory, because these memories are connected to the separate A bus and B bus.

Connecting two units of the single mode tone generator LSIs can constitute a 64-channel tone generator device. In this case, the pair of tone generator LSIs share the waveform memory and the delay memory. Therefore, one of the tone generator LSIs is set to a master, while the other is set to a slave. The master tone generator LSI sends a timing signal such as a clock signal to the slave tone generator LSI for synchronization between the two chips as well as for DRAM (Dynamic Random Access Memory) refreshment. It should be noted that the master and slave settings are also executed by the mode register 16.

In the second operation mode (or the separate mode), the access manager A block 14 connects the reading circuit 8 and the DSP 10 to the external bus terminal 18 (A bus), and the access manager B block connects the CPU 2 to the external bus terminal 19 (B bus). The A bus is connected to the Peripheral A memory in the form of an external waveform memory and an external delay memory. The B bus is connected to the Peripheral B memory in the form of an external program memory and an external work memory. At this moment, the B bus is dedicated to the CPU 2, thereby allowing the CPU 2 to fully deliver its own processing performance.

In the third operation mode (or the dual mode), the access manager A block 14 connects the reading circuit 8 and the CPU 2 to the external bus terminal 18 (A bus), and the access manager B block 15 connects the CPU 2 and the DSP 10 to the external bus terminal 19 (B bus). The external waveform memory for the reading circuit 8 and the external program memory for the CPU 2 are connected to the A bus. The external delay memory for the DSP 10 and the external work memory for the CPU 2 are connected to the B bus. In this mode, the CPU 2 and the reading circuit 8 share the A bus, so that the performance of the CPU 2 may go down. Aside, Use of an SRAM (Static Random Access Memory) of high-speed type as external memories connected to the B bus may mitigate the load on the CPU 2.

The following describes in detail the constitutional examples of electronic musical instruments using the inventive tone generator LSI configured in each of the above-mentioned three operation modes.

Figure 2:
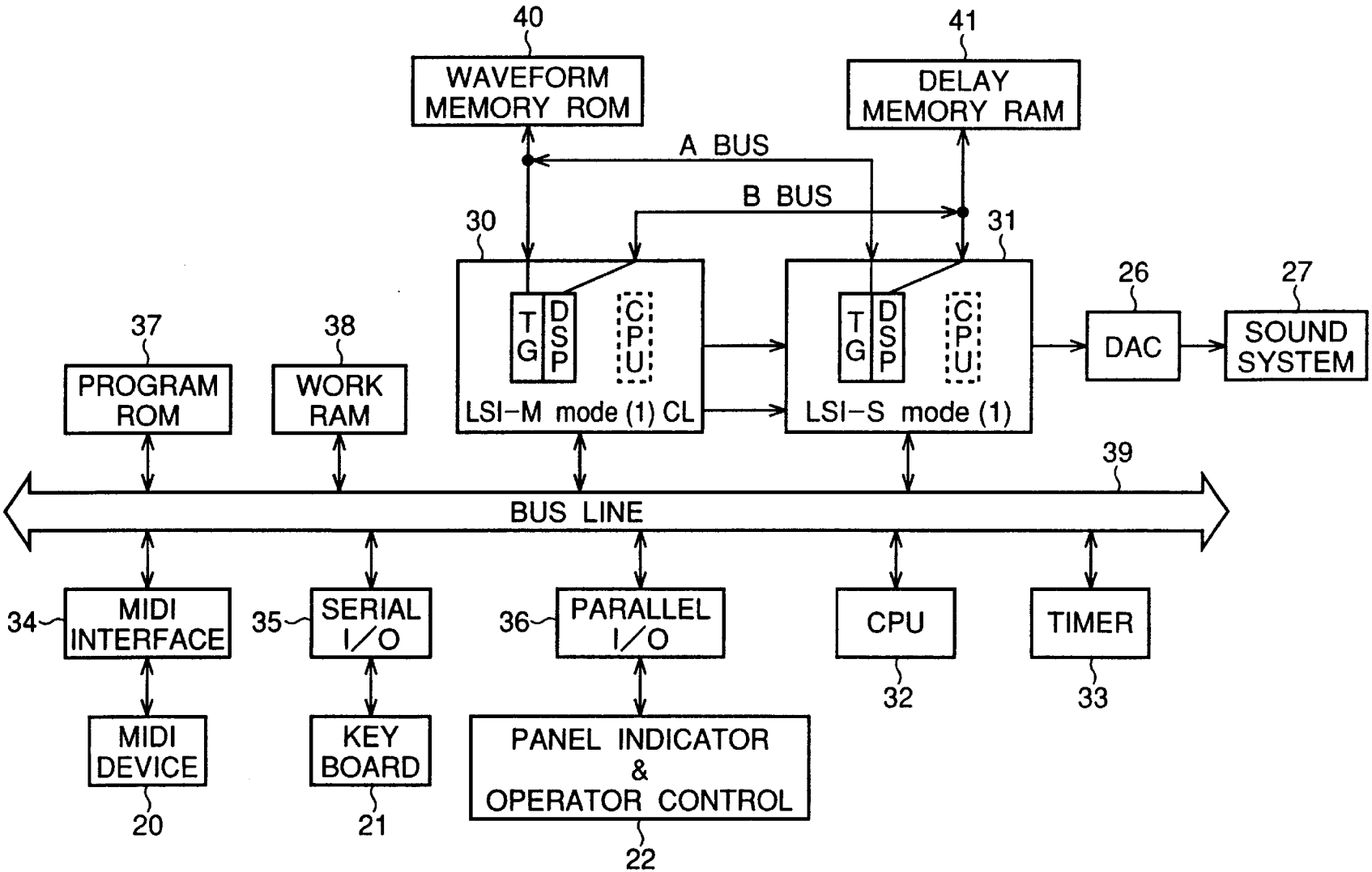
FIG. 2 is a block diagram illustrating, by way of example, one constitution of an electronic musical instrument using two units of the tone generator chips according to the invention in a first operation mode.

Referring to FIG. 2, there is shown a constitutional example of the electronic musical instrument having pair of tone generator LSIs (master and slave) configured to the first operation mode (or the single mode). In the figure, reference numerals 30 and 31 denote the tone generator LSIs according to the invention. These two LSIs are synchronized with each other by the above-mentioned timing signal. The LSI 30 is set to the master of the single mode. The LSI 31 is set to the slave of the single mode. Therefore, the CPU 2 incorporated in each of the tone generator LSIs 30 and 31 is placed in the standby mode. Reference numeral 32 denotes a CPU for executing a control operation on the entire electronic musical instrument and music performance processing. Reference numeral 33 denotes a timer for use in timing control of automatic performance and automatic accompaniment, envelope control, and effect control.

Reference numeral 34 denotes a MIDI interface circuit connected to the external MIDI terminal 20. Reference numeral 35 denotes a serial input/output circuit (or serial input/output port) connected to a keyboard 21. Reference numeral 36 denotes a parallel input/output circuit (or a parallel input/output port) connected to a panel indicator & operator control 22. Reference numeral 37 denotes a program memory in which a control program of the CPU 32 is stored. Reference numeral 38 denotes a work memory (RAM) for use by the CPU 32. Reference numeral 26 denotes an analog-to-digital converter (DAC) connected to the serial output terminal 13 of the tone generator LSI 31. The DAC 26 converts a digital signal supplied from a DSP 10 in the tone generator LSI 31 into an analog signal and outputs the same to a sound system 27. A tone signal generated by the master LSI 30 is outputted from the serial input/output terminal 12 of the tone generator LSI 30 and supplied to a serial input/output terminal of the slave tone generator LSI 31. The DSP 10 in the tone generator LSI 31 mixes the tone signal supplied from the tone generator LSI 30 with the tone signal generated by the tone generator LSI 31. The mixed tone signals are outputted to the DAC 26. It should be noted that, as described above, the CPU 2 incorporated in each of the tone generator LSIs 30 and 31 is placed in the standby mode, so that the external CPU 32 writes control data to the sound source register 7 of each of the tone generator LSIs 30 and 31 through the parallel input/output circuit 6 thereof.

Reference numeral 40 denotes a waveform memory connected to a first external bus terminal 18 of the master tone generator LSI 30 and another first external bus terminal 18 of the slave tone generator LSI 31. Reference numeral 41 denotes a delay memory connected to a second external bus terminal 19 of the master tone generator LSI 30 and another second external bus terminal 19 of the slave tone generator LSI 31. This delay memory is constituted by a DRAM for example. As described before, the tone generator LSIs 30 and 31 operate in the first operation mode, hence the access manager A block 14 of each of the tone generator LSIs 30 and 31 connects the reading circuit 8 to the first external bus terminal 18, and the access manager B block 15 connects the DSP 10 of each tone generator LSI to the second external bus terminal 19. Therefore, the waveform memory 40 is accessed by both of the master reading circuit 8 (hereafter referred to as a TG-M) of the master tone generator LSI 30 and the slave reading circuit 8 (hereafter referred to as a TG-S) of the slave tone generator LSI 31. The delay memory 41 is accessed by both of the master DSP 10 (hereafter referred to as a DSP-M) of the master tone generator LSI 30 and the slave DSP 10 (hereafter referred to as a DSP-S) of the slave tone generator LSI 31.

Figure 5A:
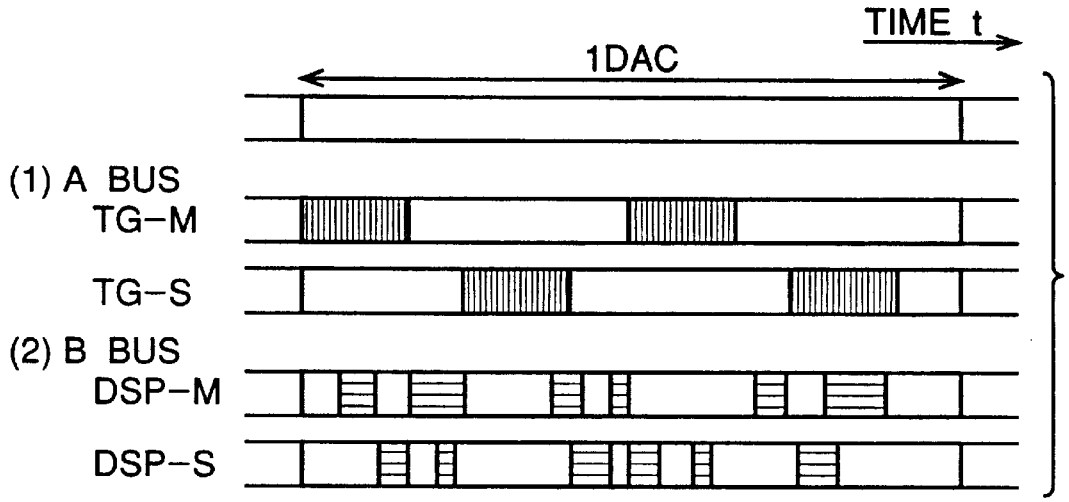
FIG. 5A, FIG. 5B, and FIG. 5C are timing charts illustrating memory access timings in the above-mentioned operation modes of the tone generator chip according to the invention.

The following describes an example of the timing of data access by the tone generator LSIs 30 and 31 to the waveform memory 40 and to the delay memory 41 with reference to a timing chart shown in FIG. 5A. As described before, in the electronic musical instrument shown in FIG. 2, the sound source blocks in the pair of tone generator LSIs 30 and 31 share the sole waveform memory 40. The inventor hereof has proposed a method of efficiently accessing one waveform memory shared by a pair of tone generator chips (Japanese Published Unexamined Patent Application No. Hei 9-146551). The above-mentioned electronic musical instrument also uses the proposed waveform memory reading method.

In the proposed method, the reading circuit executes processing A, processing B, capture processing, and interpolation processing. The processing A mainly generates an address of each channel according to a channel multiplex timing. The processing B sends a read address to the waveform memory in a timed relation different from the channel multiplex timing. The capture processing captures samples of the waveform data read out from the waveform memory according to the read address sent to the waveform memory by the processing B, and writes the captured waveform data to a waveform buffer for each channel. This waveform buffer has plural waveform data storage areas for the channels. The interpolation processing reads the waveform data of each channel from the waveform buffer according to the channel multiplex timing, interpolates the read waveform data, and outputs the interpolated waveform data.

It should be noted that the reading circuit 8 incorporated in the master tone generator LSI 30 is referred to as the TG-M and the reading circuit 8 incorporated in the slave tone generator LSI 31 is referred to as the TG-S. The TG-M divides one sampling period (namely, one DAC cycle) into a first half period and a last half period. In the first half period, the TG-M executes the processing A on channels 0 through 15. In the last half period, the TG-M executes the processing A on channels 16 through 31. The TG-S executes the processing A on channels 32 through 47 in the first half period and channels 48 through 63 in the last half period. The processing timing of the TG-S is delayed behind the processing timing of the TG-M by a ¼ DAC cycle.

A first half period of the processing B to be executed on the channels 0 through 15 by the TG-M starts immediately after the first half period of the processing A of each of these channels. A last half period of the processing B to be executed on the channels 16 through 31 by the TG-S starts immediately after the last half period of the processing A of each of these channels. The first and last halves of the processing B by the TG-S are similar to those of the processing A in timing relationship. Therefore, the first half and last half of the processing B have each a time width of ¼ of one DAC cycle. Consequently, the processing B is executed in the order of the first half period of the processing B by the TG-M on the channels 0 through 15, the first period of the processing B by the TG-S on the channels 32 through 47, the last half period of the processing B by the TG-M on the channels 16 through 31, the last half period of the processing B by the TG-S on the channels 48 through 63, and so on, thereby alternating the processing B by the TG-M and the processing B by the TG-S.

The capture processing is executed according to a timing of the address sending of the processing B. The capture processing is also executed in the order of the first half period of the capture processing by the TG-M on the channels 0 through 15, the first half period of the capture processing by the TG-S on the channels 32 through 47, the last half period of the capture processing by the TG-M on the channels 16 through 31, the last half period of the capture processing by the TG-S on the channels 48 through 63, and so on, thereby alternating the capture processing by the TG-M and the capture processing by the TG-S. The interpolation processing is sequentially executed on the channels according to the channel multiplex timing. Namely, when the timing of the first half period or the last half period of the processing B ends, interpolation of a channel concerned starts.

Each shaded portion for the TG-M and the TG-S with respect to the A bus shown in (1) of FIG. 5A denotes a timing of the waveform memory access operation to be executed by the processing B. Thus, the waveform memory access operations by the TG-M and the TG-S are alternately executed in a timed relation obtained by dividing one DAC cycle by four. As described before, the waveform memory access operation is executed in the time-divisional manner independent of the DAC cycle, so that a timing may exist in which the waveform memory is accessed by no TG as shown in FIG. 5A. If the waveform memory is constituted by a RAM, waveform data may be written to the waveform memory and the waveform data in the waveform memory may be edited by use of this free period.

When the sampling frequency is set to 44.1 KHz, one DAC cycle is set to 22.7 $\mu$s. If the pair of tone generator LSIs 30 and 31 access the 32 sound channels through the A bus to read data two times at maximum per channel, then 128 (64×2) times of access are made in one DAC cycle. Therefore, the TG-M and the TG-S each execute the read operation in a cycle of 177 ns (22.7 $\mu$s/128). The pair of tone generator LSIs share the waveform memory 40 by the time-division reading in the above-mentioned manner. But, this manner need not be limited to the disclosed embodiment. For example, the pair of tone generator LSIs may execute access operations alternately in every other waveform memory access timing or one of the pair of tone generator LSIs may execute the access operation in precedence to the other tone generator LSI.

Referring to (2) of FIG. 5A, there is shown the timing of access to the delay memory 41 by the DSP (DSP-M) in the tone generator LSI 30 set to the master and the other DSP (DSP-S) in the tone generator LSI 31 set to the slave. Because the maximum number of access operations by one DSP to the delay memory 41 is 64 times in one DAC cycle, the total maximum number of access operations to the delay memory 41 is 128 times in one DAC cycle. Therefore, in this example, the DSP-M accesses the delay memory 41 by use of an odd-number (or even-number) time slot and the DSP-S accesses the delay memory 41 by use of an even-number (or odd-number) time slot. It should be noted that each time slot has 177 ns width. In this case, the DSPs incorporated in the pair of tone generator LSIs 30 and 31 can be used without being affected by a problem such as a time lag due to the sharing of the delay memory 41. Consequently, each DSP can execute the write operation and the read operation in a timed relation as determined by the microprogram.

In the electronic musical instrument using a pair of single mode (the first operation mode) tone generator LSIs, the A bus is dedicated to the access to the waveform memory from the reading circuit of the sound source block, and the B bus is dedicated to the access to the delay memory from the DSP, so that this electronic musical instrument can generate 64 channels of tones and can impart effects to the generated tones by the two DSPs. In addition, this example allows the use of the tone generator LSI according to the invention in a mode similar to that of a conventional tone generator chip, thereby constituting a high-grade electronic musical instrument through combination with the external CPU 32 having a certain processing performance.

Referring back to FIG. 1, in the single mode, the access status of the reading circuit 8 to the first external A bus is on, the access status of the digital signal processing circuit 10 to the second external B bus is on, and the access statuses of the central processing unit 2 to the first external A bus and to the second external B bus are respectively off. Further, referring to FIG. 2, the reading circuit reads the waveform data by accessing the waveform memory 40 via the first external A bus, the digital signal processing circuit processes the waveform by utilizing the delay memory 41 via the second external B bus, and the internal central processing unit is disabled while the reading circuit and the digital signal processing circuit are controlled by the external central processing unit 32 provided separately from the tone generator chip 30.

Figure 3:
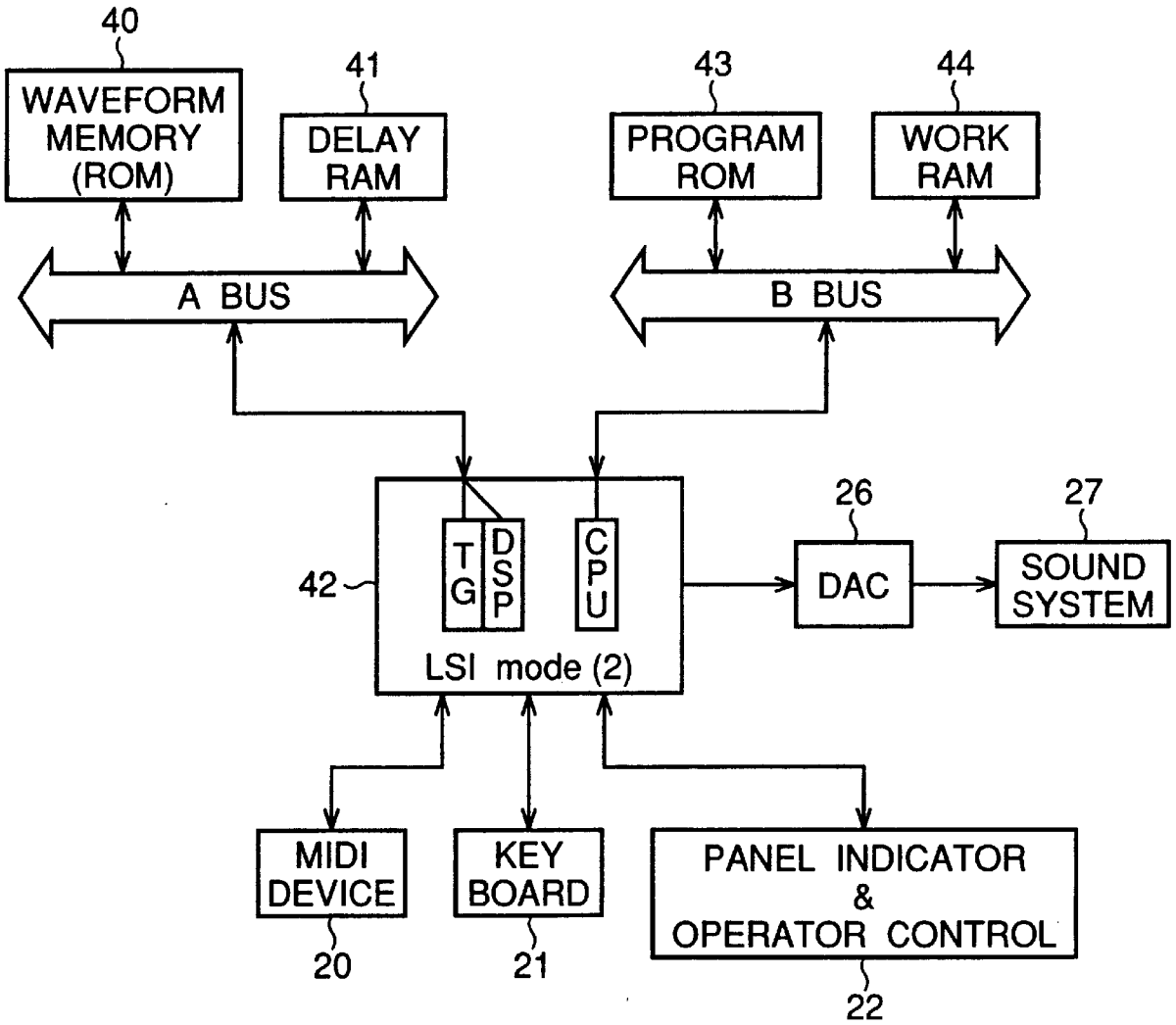
FIG. 3 is a block diagram illustrating, by way of example, another constitution of an electronic musical instrument using one unit of the tone generator chip according to the invention in a second operation mode.

The following describes the tone generator LSI according to the invention as configured in the second operation mode (or the separate mode) within an electronic musical instrument having a constitution shown in FIG. 3 for example. With reference to FIG. 3, components similar to those previously described with FIG. 2 are denoted by the same reference numerals and the description of those components will be skipped. Reference numeral 42 denotes the tone generator LSI according to the invention. This tone generator LSI 42 operates in the second operation mode (or the separate mode). As described before, in the second operation mode, the A bus is connected to both a waveform memory 40 and a delay memory 41, and the B bus is connected to a program memory (ROM) 43 and a work memory (RAM) 44 for use by an incorporated CPU 2. In the second operation mode, the A bus is shared by the waveform memory 40 and the delay memory 41, hence consideration is required for the conflicting of data access to these memories.

In the electronic musical instrument thus constituted, a MIDI device 20, a keyboard 21, and a panel indicator & operator control 22 are connected directly to a MIDI interface circuit 4, a serial input/output circuit (port) 5, and a parallel input/output circuit 6 incorporated in the tone generator LSI 42, respectively. The output of a DSP 10 incorporated in the tone generator LSI 42 is connected to a DAC 26 through the serial output terminal 13. The first external bus terminal 18 of the tone generator LSI 42 is connected to the waveform memory 40 and to the delay memory 41 through the A bus. The second external bus terminal 19 is connected to the program memory 43 and to the work memory (RAM) 44 for the CPU 2 through the B bus. This electronic musical instrument is constituted by less number of components than those of the electronic musical instrument shown in FIG. 2.

Figure 5B:
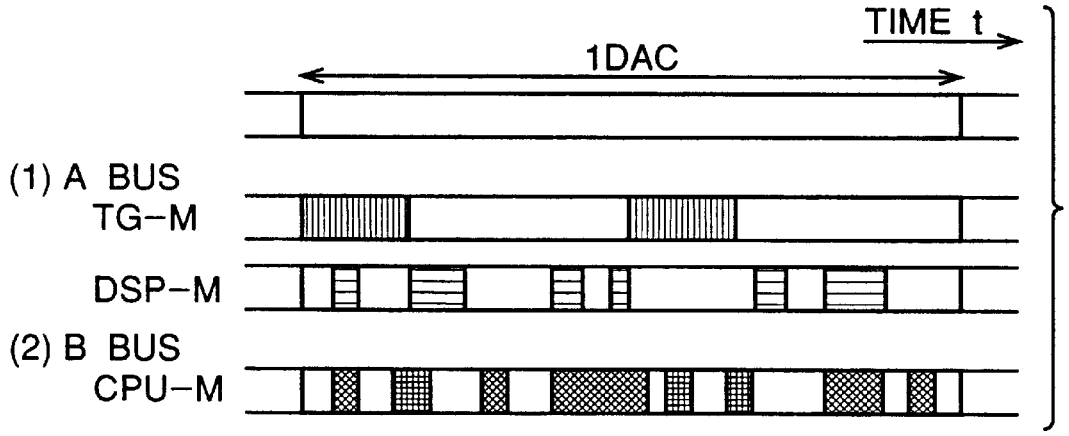

FIG. 5B shows a timing chart indicative of an example of data access to the waveform memory and the delay memory through the A bus and data access to the program memory and the work memory through the B bus in this electronic musical instrument. The waveform memory 40 connected to the A bus is accessed at a maximum of 64 times (32 channels×2) in one DAC cycle from the reading circuit 8 incorporated in the tone generator LSI 42. The delay memory 41 connected to the A bus is accessed at a maximum of 64 times (read or write accesses) in one DAC cycle from the DSP 10 incorporated in the tone generator LSI 42. Therefore, the A bus is accessed at a maximum of total 128 times in one DAC cycle. Thus, one access operation should be executed in a time slot of 177 ns.

Referring to (1) of FIG. 5B, there is shown the above-mentioned access operation by the reading circuit 8 (TG-M) and the DSP 10 (DSP-M) incorporated in the tone generator LSI 42. As with the previous example, the TG-M divides one DAC cycle into a first half period and a last half period. In the first half period, the processing A is executed on the channels 0 through 15. In the last half period, the processing B and the capture processing are executed on the channels 0 through 15 in a timed relation independent of the DAC cycle. Also, in the first half period, the processing B and the capture processing are executed on the channels 16 through 31 in a timed relation independent of the DAC cycle. The TG-M in (1) of FIG. 5B indicates the timing of the capture processing.

On the other hand, the DSP-M accesses the A bus as shown in (1) of FIG. 5B. The access manager A block 14 (FIG. 1) assigns the odd-number (or even-number) time slots each having 177 ns width obtained by dividing one DAC cycle by 128 to the TG-M, and assigns the even-number (or odd-number) time slots to the DSP-M. Therefore, the TG-M and the DSP-M each can execute a maximum of 64 memory access operations. Thus, 32 channels of tones can be generated and effect processing can be executed on the generated tones by one DSP.

Referring to (2) of FIG. 5B, there is shown a state in which the incorporated CPU 2 accesses the B bus. Each of dark-shaded portions indicates a time slot in which the CPU 2 accesses the program memory 43. Each of the light-shaded portions indicates a time slot in which the CPU 2 accesses the work memory 44. As shown, the incorporated CPU 2 can exclusively use the B bus regardless of the memory access by the sound source block (the TG-M and the DSP-M) in order to access the program memory 43 and the work memory 44, delivering the maximum processing performance of the CPU 2. Thus, in this electronic musical instrument, 32 tones can be simultaneously sounded with fewer components as compared with the electronic musical instrument shown in FIG. 2. In addition, the electronic musical instrument shown in FIG. 3 can impart effects by the DSP. In the above-mentioned example, the waveform memory 40 is constituted by a ROM. It will be apparent to those skilled in the art that the waveform data may be stored in the delay memory 41 constituted by a RAM. The constitution shown in FIG. 3 generates 32 tones suitable for medium-grade electronic musical instruments required to provide sophisticated automatic performance and automatic accompaniment capabilities.

For summary, referring back to FIG. 1, in the separate mode, the access status of the reading circuit 8 to the first external A bus is on, the access status of the digital signal processing circuit 10 to the first external A bus is on, and the access status of the central processing unit 2 to the second external B bus is on. Specifically, referring to FIG. 3, the reading circuit or TG reads the waveform data by accessing the waveform memory 40 via the first external A bus, the digital signal processing circuit Or DSP processes the waveform by utilizing the delay memory 41 via the first external A bus, and the central processing unit or CPU receives a program to control the sound source block from the program memory 43 via the second external B bus and utilizes the work memory 44 via the second external B bus. In such a case, the first access manager enables the reading circuit and the digital signal processing circuit to share the first external A bus by time-divisional access so that the reading circuit exclusively accesses the waveform memory 40 and the digital signal processing circuit exclusively accesses the delay memory 41.

Figure 4:
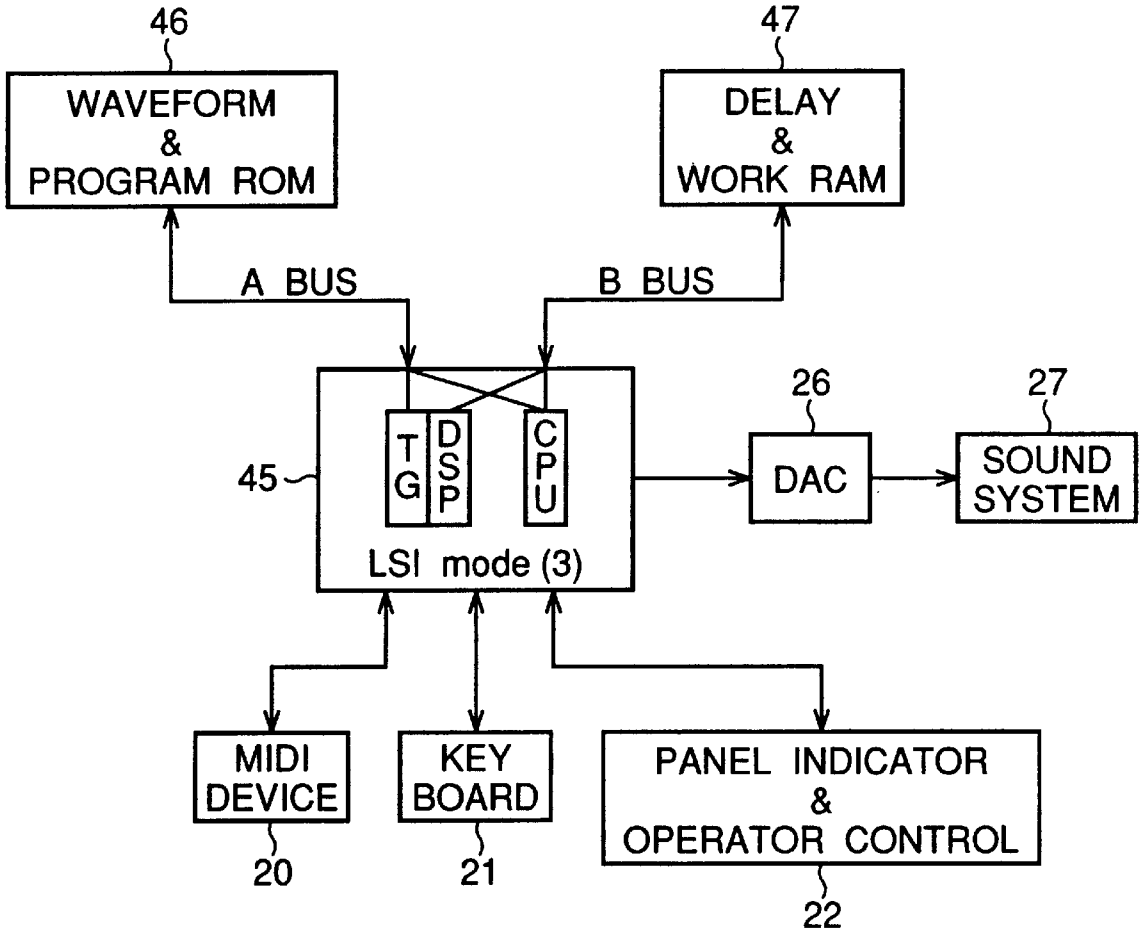
FIG. 4 is a block diagram illustrating, by way of example, a further constitution of an electronic musical instrument using one unit of the tone generator chip according to the invention in a third operation mode.
Figure 5C:
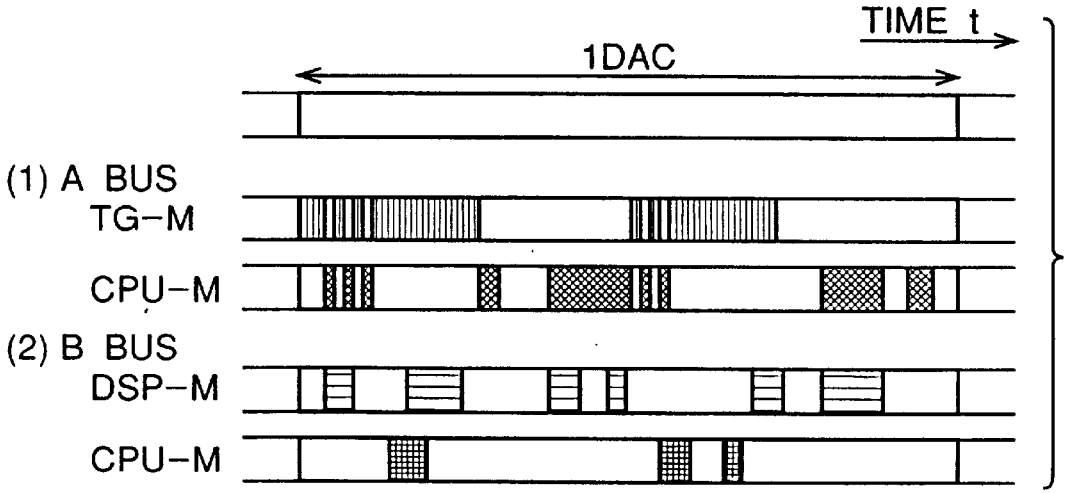

The following describes the tone generator LSI according to the invention as configured in the third operation mode (or the dual mode) with reference to an example of an electronic musical instrument shown in FIG. 4 and a timing chart shown in FIG. 5C. The electronic musical instrument shown in FIG. 4 can generate 32 channels of tones and can impart effects by the DSP. With reference to FIG. 4, components similar to those previously described with reference to FIG. 2 and FIG. 3 are denoted by the same reference numerals and the description of those components will be skipped. Reference numeral 45 denotes the tone generator LSI according to the invention set to the third operation mode. Reference numeral 46 denotes a memory connected to the first external bus terminal 18 of the tone generator LSI 45. This memory is a waveform & program ROM in which waveform data and a control program of the CPU 2 are stored. Reference numeral 47 is another memory connected to the second external bus terminal 19 of the tone generator LSI 45. This memory is a delay & work RAM for use as a delay memory of the DSP and a work memory of the CPU 2. As shown in FIG. 4, the use of the tone generator LSI of the third operation mode reduces the number of components of the electronic musical instrument as compared with the electronic musical instrument shown in FIG. 3.

As described before, the tone generator LSI 45 operates in the third operation mode. In this mode, both the reading circuit 8 and the incorporated CPU 2 access the waveform & program memory 46 connected to the A bus. Both the DSP 10 and the incorporated CPU 2 access the delay & work memory 47 connected to the B bus.

The following describes the access schedule to the A bus and the B bus with reference to FIG. 5C. The timing in which the A bus is accessed is one time slot of 177 ns as with the examples shown in FIGS. 2 and 3. Therefore, 128 access operations can be executed in one DAC cycle. As described before, because the electronic musical instrument shown in FIG. 4 has 32 sound channels, the reading circuit 8 (TG-M) must access the waveform memory at a maximum of 64 times in one DAC cycle. Therefore, the incorporated CPU 2 comes to access the program memory in the remaining time slots (there are at least 64 time slots). Namely, if the TG-M is accessing the A bus when the CPU 2 accesses the A bus, a wait instruction is inserted to delay the access of the CPU 2 to the program memory, thereby slightly lowering the processing performance of the CPU 2. This is indicated in (1) of FIG. 5C. As shown, if there occurs a conflict between the access by the TG-M and the access by the CPU-M, the TG-M and the CPU-M use the A bus alternately.

To reduce the affect of the lowered processing performance of the CPU 2, an instruction stored in the program memory is transferred to the delay & work RAM 47 for execution therein. Alternatively, a channel not sounding or terminated with damping is prevented from accessing the waveform memory. Alternatively still, if the waveform data is an 8-bit linear waveform, waveform extrapolation is executed for example.

As for the B bus, the DSP 10 accesses the delay memory 47 at a maximum of 64 times in one DAC cycle as described above. The CPU 2 also accesses the work memory from time to time. Therefore, to prevent the processing performance of the CPU 2 from lowering due to the access conflict on the B bus, the CPU 2 and the DSP 10 make two-state access (88.6 ns) to the B bus without wait, and a medium-to-high-speed static RAM (SRAM) is used for the delay & work RAM 47 in the electronic musical instrument shown in FIG. 4. This constitution allows 256 access operations to the delay & work RAM in one DAC cycle. The DSP 10 uses the odd-number (or even-number) time slots among the 256 time slots each having 88.6 ns width, and the CPU 2 uses the even-number (or odd-number) time slots. The medium-to-high-speed SRAM is used because the same is widely used and therefore readily available at a reasonably low cost. On the other hand, a high-speed ROM is currently not so widely used, making it comparatively difficult for use in the delay & work memory.

Referring to (2) of FIG. 5C, there is shown a state of access to the B bus. As shown, since the medium-to-high-speed SRAM is used, the access can be made at generally the similar speed to that of the separate mode ((2) of FIG. 5B). Thus, the electronic musical instrument shown in FIG. 4 can simultaneously sound 32 channels of tones with comparatively fewer components and, at the same time, can impart effects by use of the DSP. Although the access by the CPU 2 to the program memory is slightly delayed, an enough speed can be ensured for general use. Because the waveform data and the control program are stored in one ROM, and both the delay memory and the work memory are constituted in one RAM, the number of components is reduced and the physical size of a circuit board on which these components are mounted is reduced, realizing overall size reduction and cost reduction. The constitution shown in FIG. 4 uses 32 sound channels and therefore is suitable for use in a low-grade electronic musical instrument capable of performing simple automatic performance and automatic accompaniment.

For summary, referring back to FIG. 1, in the dual mode, the access status of the reading circuit 8 to the first external A bus is on, the access status of the digital signal processing circuit 10 to the second external B bus is on, and the access statuses of the central processing unit 2 to the first external A bus and to the second external B bus are respectively on. Specifically, as shown in FIG. 4, the reading circuit (TG) reads the waveform data by accessing the waveform memory 46 via the first external A bus, the digital signal processing circuit (DSP) processes the waveform by utilizing the delay memory 47 via the second external B bus, and the central processing unit (CPU) receives a program to control the sound source block from the program memory 46 via the first external A bus and utilizes the work memory 47 via the second external B bus. In such a case, the first access manager enables the reading circuit and the central processing unit to share the first external A bus by time-divisional access so that the reading circuit exclusively accesses the waveform memory and the central processing unit exclusively accesses the program memory. Actually, the waveform memory and the program memory are integrated into one chip. The second access manager enables the digital signal processing circuit and the central processing unit to share the second external B bus by time-divisional access so that the digital signal processing circuit exclusively accesses the delay memory and the central processing unit exclusively accesses the work memory. Actually, the delay memory and the work memory are integrated into one chip.

Figure 6:
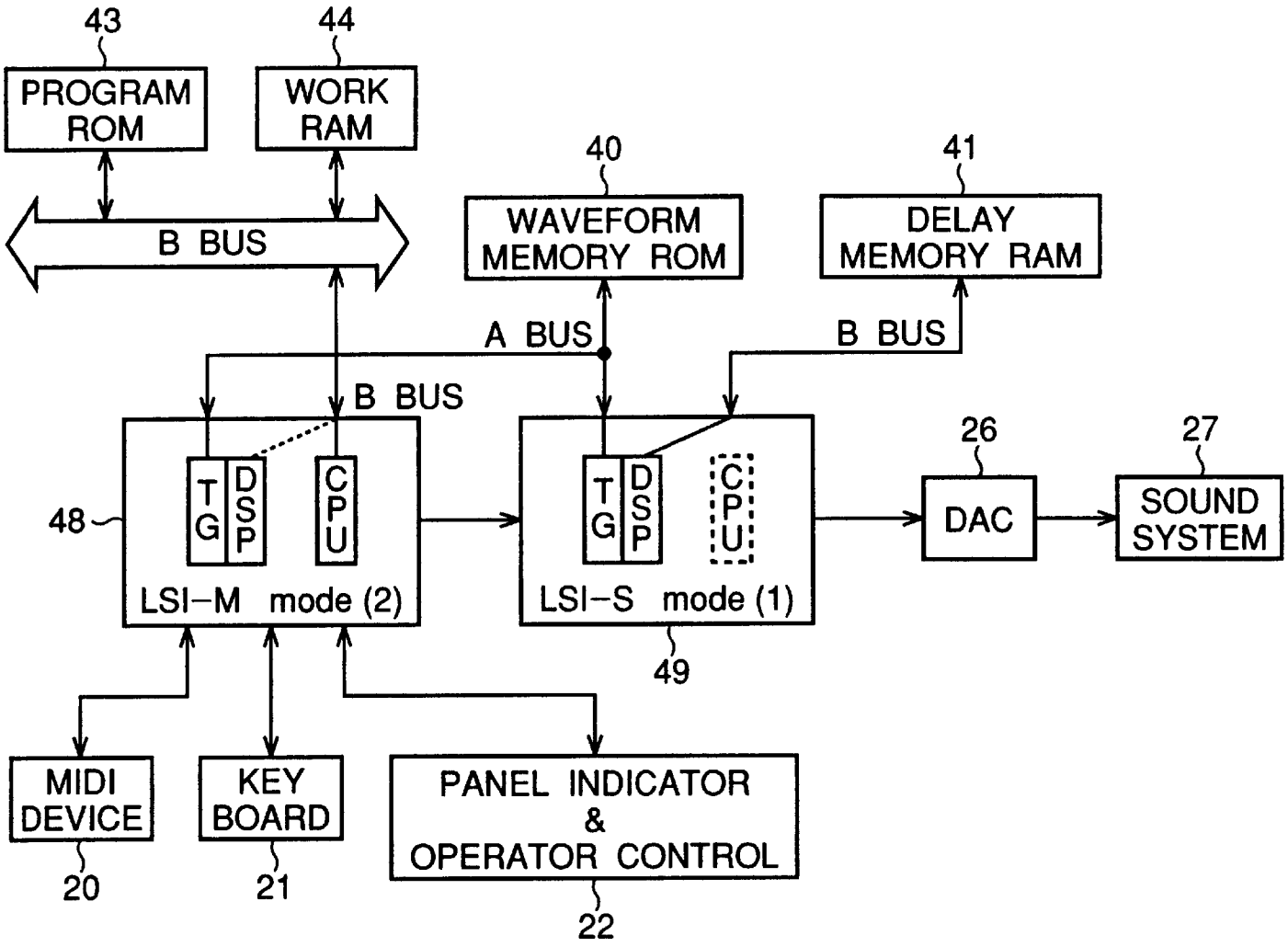
FIG. 6 is a block diagram illustrating a still further constitution of an electronic musical instrument using two units of the tone generator chips according to the invention.

The foregoing has described the tone generator LSI according to the invention as configured to the first through third operation modes. It is also practicable to constitute an electronic musical instrument by use of two or more tone generator LSIs configured to different operation modes according to the invention. FIG. 6 is a block diagram illustrating a constitution of an electronic musical instrument for simultaneously sounding 64 channels by use of a pair of tone generator LSIs configured to different operation modes according to the invention. With reference to FIG. 6, components similar to those previously described with reference to FIGS. 2 through 4 are denoted by the same reference numerals and the description of those components will be skipped. Reference numeral 48 denotes one tone generator LSI configured to the above-mentioned second operation mode (or the separate mode) according to the invention. Reference numeral 49 denotes another tone generator LSI configured to the above-mentioned first operation mode (or the single slave mode) and set to a slave for the LSI 48. Therefore, the tone generator LSI 48 is the master and the tone generator LSI 49 is the slave. A timing signal, a tone signal, and so on are supplied from the master tone generator LSI 48 to the slave tone generator LSI 49. In this example, a DSP 10 incorporated in the tone generator LSI 48 cannot access a delay memory, so that only effect processing by use of a data register in the DSP 10 is enabled (or only effect processing that requires no relatively long delay is enabled). Such an effect processing includes digital filtering and equalizing for example.

Consequently, a waveform memory 40 is commonly connected to the first external bus terminal 18 of the tone generator LSI 48 and to the first external bus terminal 18 of the tone generator LSI 49. A program ROM 43 and a work memory (RAM) 44 of the CPU 2 incorporated in the tone generator LSI 48 are connected to the B bus through the external bus terminal 19 of the tone generator LSI 48. A delay memory 41 of the DSP 10 incorporated in the tone generator LSI 49 is connected to the second external terminal 19 of the tone generator LSI 49. Further, a MIDI device 20, a keyboard 21, and a panel indicator & operator control 22 are connected directly to the MIDI interface circuit 4, the serial input/output circuit 5, and the parallel input/output circuit 6 (refer to FIG. 1) incorporated in the master tone generator LSI 48, respectively. A DAC 26 is connected to the serial input/output terminal 13 of the slave tone generator LSI 49, the output of the DAC 26 being connected to a sound system 27. A tone signal generated by the tone generator LSI 48 is outputted from the serial input/output terminal 12 of the tone generator LSI 48, and is supplied to the serial input/output terminal 12 of the tone generator LSI 49. The DSP 10 of the tone generator LSI 49 mixes the tone signal supplied from the tone generator LSI 48 with the tone signal generated by the tone generator LSI 49 for effect processing, thereby outputting a resultant tone signal to the DAC 26.

In this example, the CPU 2 incorporated in the tone generator 48 exclusively uses the B bus of the tone generator LSI 48 to access the program ROM 43 and the work RAM 44, thereby fully exerting the processing performance of the CPU 2. The reading circuit (TG-M) of the tone generator LSI 48 and the reading circuit (TG-S) of the tone generator LSI 49 can access the waveform memory 40 on the A bus in 128 three-state access operations in one DAC cycle, thereby reading 64 channels of waveform data in one DAC cycle. Further, the DSP in the tone generator LSI 49 can access the delay memory 41 through the B bus of the tone generator 49, 128 times in one DAC cycle, thereby imparting 64 channels of effects by this DSP. It should be noted that the CPU 2 in the tone generator LSI 48 controls both of the sound source block in the master chip 48 and the sound source block in the slave chip 49. Thus, the electronic musical instrument is capable of sounding 64 tones and imparting effects through the DSP. In this example, the CPU 2 in the tone generator LSI 48 controls all the 64 channels. As the number of tones increases, the load of tone generator driver processing drastically increases, making it difficult to add other electronic musical instrument capabilities. The constitution shown in FIG. 6 is suitable for a medium-grade single-capability electronic piano of more tones in any case at the expense of capabilities.

In the above-mentioned constitution, the DSP in the tone generator LSI 48 does not access the delay memory. So, the output of the DSP incorporated in the tone generator LSI 48 may be connected to the B bus as indicated by a dashed line in FIG. 6, and a delay memory area to be accessed by the DSP 10 may be arranged in the RAM connected to the B bus, thereby sharing the program memory and the work memory of the CPU 2 on the B bus. If a bus access conflict occurs between the CPU 2 and the DSP 10, the access by the DSP 10 precedes. In consequence, the processing performance of the CPU is decreased by the number of access operations executed by the DSP 10. However, limiting the number of access operations by the DSP in the order of 5 to 6 times will sufficiently suppress this problem. This constitution allows, by use of the DSP in the tone generator LSI 48, creation of such an effect as microphone echo requiring a relatively long delay.

It should be noted that, because the CPU 2 can configure the data bus width for each of the memory areas obtained by dividing the address space, the number of bits constituting one word of waveform data to be stored in the waveform memory and the delay memory may be set to 8, 16, or any other values. In the foregoing, the invention has been described by use of electronic musical instruments for example. It will be apparent that the invention is also similarly applicable to a tone generator board or sound card for example connected to a general-purpose personal computer.

As described and according to the tone generator chip associated with the invention, two or more operation modes can be configured logically, allowing the tone generator chip to be compatible with any desired usage. In addition, the novel arrangement allows the tone generator chip to efficiently access two or more memories connected to one external bus.

While the preferred embodiments of the present invention have been described using specific terms, such description is for illustrative purposes only, and it is to be understood that changes and variations may be made without departing from the spirit or scope of the appended claims.

What is claimed is:

1. A tone generator circuit integrated in a semiconductor substrate and being alterable under different operation modes for generating a tone by accessing external buses, the circuit comprising:

a sound source block that is controllable for generating a tone and that includes a reading circuit for reading waveform data to generate the tone, an envelope circuit for forming an envelope of the waveform data to regulate an amplitude of the tone, and a digital signal processing circuit for processing the waveform data to impart an effect to the tone;

a central processing unit that is integrated in the semiconductor substrate together with the sound source block for controlling the sound source block;

a first terminal that is provided on the semiconductor substrate for connection with a first external bus;

a second terminal that is provided separately from the first terminal on the same semiconductor substrate for connection with a second external bus;

a first access manager that manages an access status from each of the reading circuit, the digital signal processing circuit and the central processing unit to the first external bus via the first terminal;

a second access manager that manages an access status from each of the reading circuit, the digital signal processing circuit and the central processing unit to the second external bus via the second terminal; and a mode control that designates one of the different operation modes so that the first access manager and the second access manager alter the respective access statuses from each of the reading circuit, the digital signal processing circuit and the central processing unit to each of the first external bus and the second external bus according to the designated operation mode.

2. The tone generator circuit according to claim 1, wherein the mode control designates one of the different operation modes selected from the group consisting of:

a single mode where the access status of the reading circuit to the first external bus is on, the access status of the digital signal processing circuit to the second external bus is on, and the access statuses of the central processing unit to the first external bus and to the second external bus are respectively off;

a dual mode where the access status of the reading circuit to the first external bus is on, the access status of the digital signal processing circuit to the second external bus is on, and the access statuses of the central processing unit to the first external bus and to the second external bus are respectively on; and a separate mode where the access status of the reading circuit to the first external bus is on, the access status of the digital signal processing circuit to the first external bus is on, and the access status of the central processing unit to the second external bus is on.

3. The tone generator circuit according to claim 1, further comprising additional terminals provided on the semiconductor substrate for connection with another tone generator circuit so that the pair of the tone generator circuits cooperate with each other as a master circuit and a slave circuit.

4. A tone generator circuit integrated in a semiconductor substrate and being alterable under different operation modes for generating a tone by accessing external buses, the circuit comprising:

a sound source block that is controllable for generating a tone and that includes a reading circuit for reading waveform data to generate the tone, an envelope circuit for forming an envelope of the waveform data to regulate an amplitude of the tone, and a digital signal processing circuit for processing the waveform data to impart an effect to the tone;

a central processing unit that is integrated in the semiconductor substrate together with the sound source block for controlling the sound source block;

a first terminal that is provided on the semiconductor substrate for connection with a first external bus;

a second terminal that is provided separately from the first terminal on the same semiconductor substrate for connection with a second external bus;

a first access manager that manages an access status from each of the reading circuit, the digital signal processing circuit and the central processing unit to the first external bus via the first terminal;

a second access manager that manages an access status from each of the reading circuit, the digital signal processing circuit and the central processing unit to the second external bus via the second terminal; and a mode control that designates either of one operation mode where the access status of the reading circuit to the first external bus is on, the access status of the digital signal processing circuit to the first external bus is on, and the access status of the central processing unit to the second external bus is on, or designates another operation mode where the access status of the reading circuit to the first external bus is on, the access status of the digital signal processing circuit to the second external bus is on, and the access statuses of the central processing unit to the first external bus and to the second external bus are respectively on, wherein under said one operation mode, the first access manager enables the reading circuit and the digital signal processing circuit to share the first external bus by time-divisional access, and under said another operation mode, the first access manager enables the reading circuit and the central processing unit to share the first external bus by time-divisional access, and the second access manager enables the digital signal processing circuit and the central processing unit to share the second external bus by time-divisional access.

5. A tone generator chip formed of a semiconductor substrate and being configurable under different operation modes in combination with memories accessible via external buses for generating a tone by using the memories, the tone generator chip comprising:

a sound source block that is controllable for generating a tone and that includes at least a reading circuit for reading waveform data to generate the tone and a digital signal processing circuit for processing the waveform data to impart an effect to the tone;

a central processing unit that is integrated in the semiconductor substrate together with the sound source block for controlling the sound source block;

a first access manager that manages an access status from each of the reading circuit, the digital signal processing circuit and the central processing unit to a first external bus for access to a memory;

a second access manager that manages an access status from each of the reading circuit, the digital signal processing circuit and the central processing unit to a second external bus provided separately from the first external bus for access to another memory; and a mode control that designates a specific one of the different operation modes to enable the first access manager and the second access manager to set the respective access statuses from each of the reading circuit, the digital signal processing circuit and the central processing unit to each of the first external bus and the second external bus, thereby configuring the reading circuit, the digital signal processing circuit and the central processing unit according to the specific operation mode in combination with the memories configured corresponding to the specific operation mode.

6. The tone generator chip according to claim 5, wherein the mode control designates a specific operation mode so that the access status of the reading circuit to the first external bus is on, the access status of the digital signal processing circuit to the second external bus is on, and the access statuses of the central processing unit to the first external bus and to the second external bus are respectively off.

7. The tone generator chip according to claim 6, wherein the reading circuit reads the waveform data by accessing a waveform memory via the first external bus, the digital signal processing circuit processes the waveform by utilizing a delay memory via the second external bus, and the central processing unit is disabled while the reading circuit and the digital signal processing circuit are controlled by another central processing unit provided separately from the tone generator chip.

8. The tone generator chip according to claim 5, wherein the mode control designates a specific operation mode so that the access status of the reading circuit to the first external bus is on, the access status of the digital signal processing circuit to the first external bus is on, and the access status of the central processing unit to the second external bus is on.

9. The tone generator chip according to claim 8, wherein the reading circuit reads the waveform data by accessing a waveform memory via the first external bus, the digital signal processing circuit processes the waveform by utilizing a delay memory via the first external bus, and the central processing unit receives a program to control the sound source block from a program memory via the second external bus and utilizes a work memory via the second external bus.

10. The tone generator chip according to claim 9, wherein the first access manager enables the reading circuit and the digital signal processing circuit to share the first external bus by time-divisional access so that the reading circuit exclusively accesses the waveform memory and the digital signal processing circuit exclusively accesses the delay memory.

11. The tone generator chip according to claim 5, wherein the mode control designates a specific operation mode so that the access status of the reading circuit to the first external bus is on, the access status of the digital signal processing circuit to the second external bus is on, and the access statuses of the central processing unit to the first external bus and to the second external bus are respectively on.

12. The tone generator chip according to claim 11, wherein the reading circuit reads the waveform data by accessing a waveform memory via the first external bus, the digital signal processing circuit processes the waveform by utilizing a delay memory via the second external bus, and the central processing unit receives a program to control the sound source block from a program memory via the first external bus and utilizes a work memory via the second external bus.

13. The tone generator chip according to claim 12, wherein the first access manager enables the reading circuit and the central processing unit to share the first external bus by time-divisional access so that the reading circuit exclusively accesses the waveform memory and the central processing unit exclusively accesses the program memory, and the second access manager enables the digital signal processing circuit and the central processing unit to share the second external bus by time-divisional access so that the digital signal processing circuit exclusively accesses the delay memory and the central processing unit exclusively accesses the work memory.

14. A method of adaptively configuring a tone generator chip according to different operation modes in combination with peripheral memory devices accessible via external buses, the tone generator chip comprising a sound source block including at least a reading circuit for reading waveform data to generate a tone and a digital signal processing circuit for processing the waveform data to impart an effect to the tone, and a central processing unit integrated in a semiconductor substrate together with the sound source block for controlling the sound source block, the method comprising the steps of:

first managing an access status from each of the reading circuit, the digital signal processing circuit and the central processing unit to a first external bus for access to a peripheral memory device;

second managing an access status from each of the reading circuit, the digital signal processing circuit and the central processing unit to a second external bus provided separately from the first external bus for access to another peripheral memory device; and designating a specific one of the different operation modes to allow the first managing step and the second managing step to set the respective access statuses from each of the reading circuit, the digital signal processing circuit and the central processing unit to each of the first external bus and the second external bus, thereby configuring the reading circuit, the digital signal processing circuit and the central processing unit according to the specific operation mode in combination with the peripheral memory devices in correspondence to the specific operation mode.

* * * * *